US011130665B1

(12) United States Patent
Karpinskyy

(10) Patent No.: US 11,130,665 B1
(45) Date of Patent: Sep. 28, 2021

(54) MOBILE RECREATIONAL LIFT SYSTEM AND METHOD

(71) Applicant: Yuriy Karpinskyy, Brooklyn, NY (US)

(72) Inventor: Yuriy Karpinskyy, Brooklyn, NY (US)

( * ) Notice: Subject to any disclaimer, the term of this patent is extended or adjusted under 35 U.S.C. 154(b) by 323 days.

(21) Appl. No.: 16/532,217

(22) Filed: Aug. 5, 2019

(51) Int. Cl.
*B66F 11/04* (2006.01)
*B66F 17/00* (2006.01)
*A63G 31/02* (2006.01)

(52) U.S. Cl.
CPC ..... *B66F 11/044* (2013.01); *A63G 31/02* (2013.01); *B66F 17/006* (2013.01); *A63G 2200/00* (2013.01)

(58) Field of Classification Search
CPC ..... B66F 11/00; B66F 11/04; B66F 11/044; B66F 11/046; B66F 11/048; B66F 17/006; A63G 31/02; A63G 2200/00
See application file for complete search history.

(56) References Cited

U.S. PATENT DOCUMENTS 1,867,996 A 7/1932 Baer
2,983,509 A * 5/1961 Haug ..... A63G 1/30 472/39
3,653,657 A 4/1972 Bishop
3,666,264 A * 5/1972 Bartlett ..... A63G 1/34 472/3
3,840,225 A * 10/1974 Fouche ..... A63G 1/10 472/3
3,905,596 A * 9/1975 Barber ..... A63G 1/28 472/3
4,007,926 A 2/1977 Ottaway
5,314,383 A * 5/1994 Fabbri ..... A63G 9/08 472/3
5,598,208 A * 1/1997 McClintock ..... G11B 27/028 348/157
5,791,998 A * 8/1998 Moser ..... A63G 27/04 472/31
5,957,779 A * 9/1999 Larson ..... A63G 1/44 472/34
7,744,476 B2 * 6/2010 Knijpstra ..... A63G 27/04 472/31
9,915,396 B2 * 3/2018 Castro Salinas ..... B66F 11/044
10,166,485 B2 * 1/2019 Girlya ..... A63G 31/14
10,843,093 B1 * 11/2020 Bloomfield ..... G05B 15/02
2019/0224579 A1 * 7/2019 Hall ..... A63G 31/00

* cited by examiner

*Primary Examiner* — Alvin C Chin-Shue
*Assistant Examiner* — Shiref M Mekhaeil
(74) *Attorney, Agent, or Firm* — Goldstein Law Offices, P.C.

(57) ABSTRACT

A mobile recreational lift system, comprising a first lift vehicle and a second lift vehicle, each lift vehicle having an observation platform for carrying passengers, and an articulating lift mechanism for elevating the observation platform above a ground surface. The lift vehicles are positioned at an observation site in a paired configuration, allowing the observation platforms of both vehicles to be elevated simultaneously while retaining the ability to be independently controlled. The lift mechanisms are also adapted to move the observation platforms laterally, allowing the observation platforms to be placed in close proximity to allow the passengers to interact. If one of the lift vehicles malfunctions, the other lift vehicle may immediately position its observation platform to aid the passengers of the malfunctioning vehicle. Cameras mounted on each observation platform are adapted to capture images of the other observation platform and the passengers therein, from a variety of perspectives.

10 Claims, 6 Drawing Sheets

MOBILE RECREATIONAL LIFT SYSTEM AND METHOD

TECHNICAL FIELD

The present disclosure relates generally to an amusement ride. More particularly, the present disclosure relates to a recreational lift system and method employing two elevated observation platforms for conducting simultaneous elevated observation tours.

BACKGROUND

Amusement rides that elevate passengers above the ground are widespread and diverse. Tower rides, Ferris wheels, tilting swing rides, pendulum rides, and a variety of other types of rides all operate by raising their passengers into the air to create enjoyment and excitement. Existing amusement rides operate using a single apparatus to which gondolas, cabins, buckets, or seats containing the passengers are fixed and are incapable of independent movement. For example, tower rides can only raise and lower passengers along the vertical axis. Ferris wheels employ pivoting buckets which are permanently fixed along a vertically rotating wheel. Swing rides operate in a similar manner to Ferris wheels, but rotate along a substantially horizontal plane while swinging passengers suspended in seats. The amusement rides are thus designed to move in a fixed pattern which may not be adjusted to accommodate passenger preferences.

Many amusement rides incorporate cameras which capture images of the passengers as they experience the rides. However, these cameras are mounted at fixed points within the ride, and are generally adapted to capture close up images of the passengers to record amusing expressions and reactions.

Furthermore, when conventional amusement rides malfunction, passengers may become stranded above the ground, and it becomes necessary to obtain assistance from rescue personnel with specialized equipment capable of reaching and rescuing the passengers. While waiting to be rescued, passengers may experience distress, particularly if there is a long delay between the occurrence of the malfunction and the arrival of rescue personnel.

A need therefore exists for a recreational lift system which allows for multiple camera equipped passenger platforms with articulated lift mechanisms to be simultaneously elevated while allowing each platform to be independently controlled, thus allowing each platform to photograph the other platform, while further allowing one of the platforms to immediately aid the other platform in the event of a malfunction.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a lift system which allows two passenger-carrying platforms to be simultaneously elevated above a ground surface in the course of an observation tour. Accordingly, the present disclosure provides a mobile recreational lift system comprising two lift vehicles, each having an observation platform adapted to carry passengers and having an operator, and a lift mechanism adapted to alternatively raise and lower the observation platform away from or towards the ground surface.

It is another aspect of an example embodiment in the present disclosure to provide a lift system which allows the passengers in one observation platform to interact with the passengers in the other observation platform. Accordingly, the present disclosure provides a mobile recreational lift system in which the lift mechanism is capable of moving the observation platform laterally, and the lift vehicles are positioned in a paired arrangement and are separated by an operating interval. The lift mechanism of each lift vehicle is adapted to laterally move the observation platform across the operating interval to approach the observation platform of the other lift vehicle, thus placing the passengers within both observation platforms in close proximity and facilitating interaction.

It is still another aspect of an example embodiment in the present disclosure to provide a lift system which allows photographs and video of each observation platform to be captured by the other observation platform during the observation tour. Accordingly, the present disclosure provides a mobile lift system whereby each observation platform has one or more cameras oriented towards the other observation platform, allowing images of the other observation platform and the passengers to be captured.

It is a further aspect of an example embodiment in the present disclosure to provide a lift system in which passengers may be immediately rescued in the event of a malfunction affecting one of the lift vehicles. Accordingly, the present disclosure provides a mobile lift system in which the paired arrangement of the lift vehicles allows the observation platform of one of the lift vehicles to be immediately moved proximate to the observation platform of the lift vehicle experiencing the malfunction, allowing the operator to render assistance as well as allowing the passengers of the malfunctioning lift vehicle to be transferred and returned to the ground surface.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
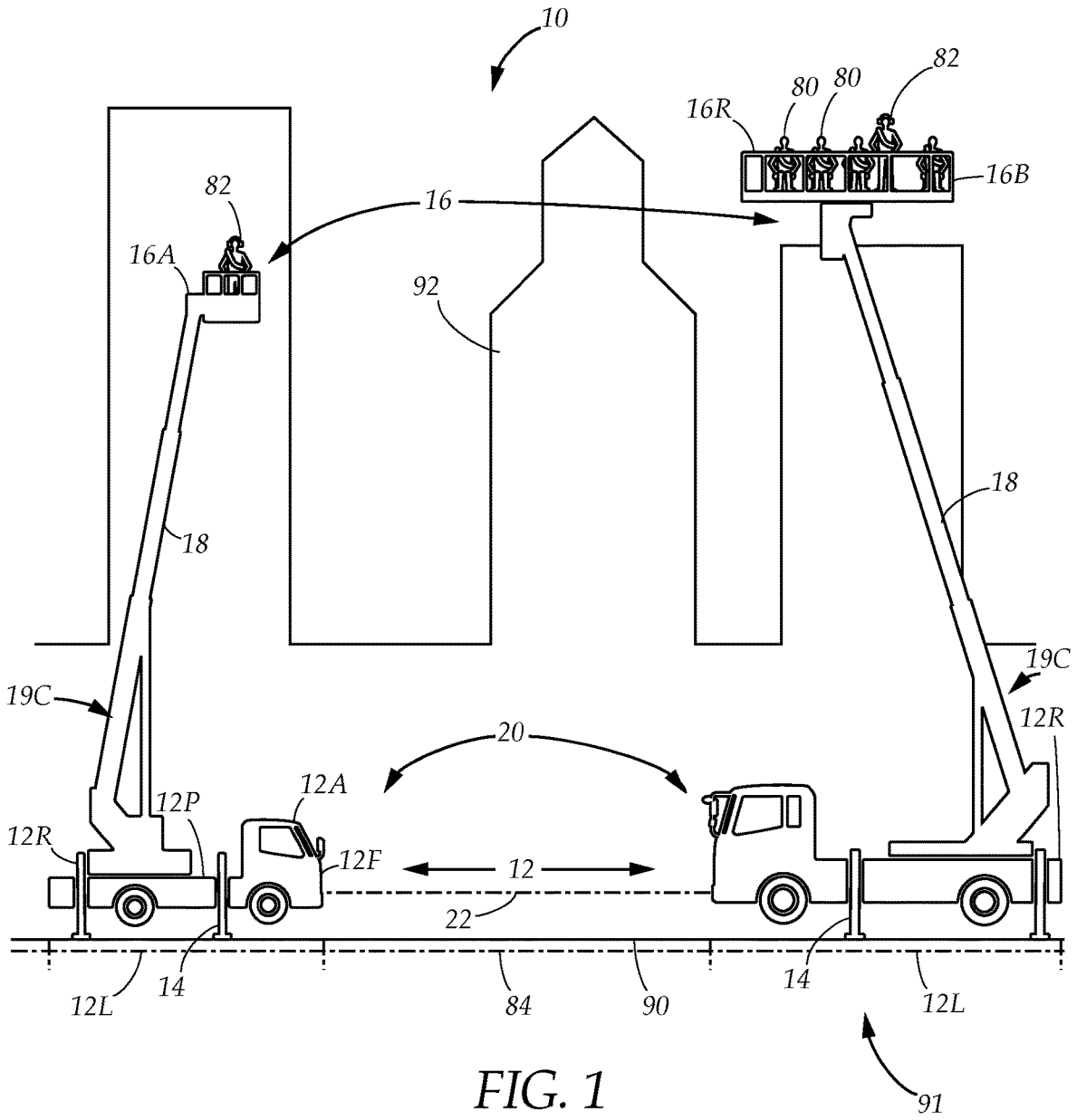
FIG. 1 is a diagrammatical side view of a mobile recreational lift system having a pair of lift vehicles comprising a first lift vehicle and a second lift vehicle, each lift vehicle having an observation platform and a lift mechanism, each observation platform is adapted to support an operator and one or more passengers, in accordance with an embodiment in the present disclosure.

FIG. 1 illustrates a mobile recreational lift system 10 having a pair of lift vehicles 12 comprising a first lift vehicle 12A and a second lift vehicle 12B. The lift vehicles 12 are mobile and are capable of traveling between various locations. In certain embodiments, boom lift trucks may be modified to serve as lift vehicles 12. Each lift vehicle 12 has a vehicle body 12P, an observation platform 16, and a lift mechanism 18 which is connected to the vehicle body 12P and is adapted to raise and lower the observation platform 16. In one embodiment, the lift mechanism 18 may be an articulating boom lift. Each observation platform 16 is adapted to receive and support an operator 82 and one or more passengers 80. The mobile recreational lift system 10 is employed at an observation site 91 located upon a ground surface 90. The observation site 91 may be encompassed within a surrounding environment 92 which may contain scenery, such as buildings and natural terrain features, which are suited to recreational viewing from an elevated height. Each lift vehicle 12 is adapted to facilitate an elevated observation tour by raising its observation platform 16 away from the ground surface 90, thus providing the passengers 80 within with an elevated view of a surrounding environment 92. As the mobile recreational lift system 10 has two lift vehicles 12, two elevated observation tours may be conducted simultaneously.

Figure 2A:
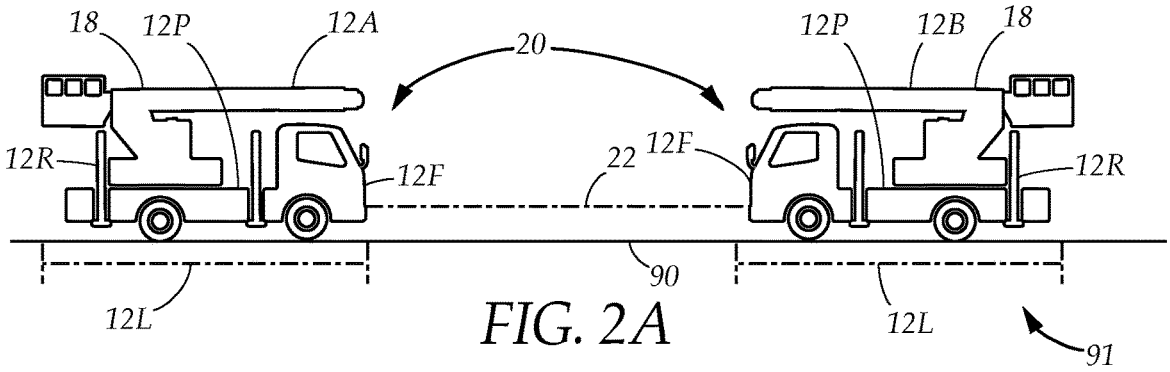
FIG. 2A is a diagrammatical side view showing the pair of lift vehicles in a paired arrangement where the front of the first lift vehicle faces the front of the second lift vehicle, in accordance with an embodiment in the present disclosure.
Figure 2B:
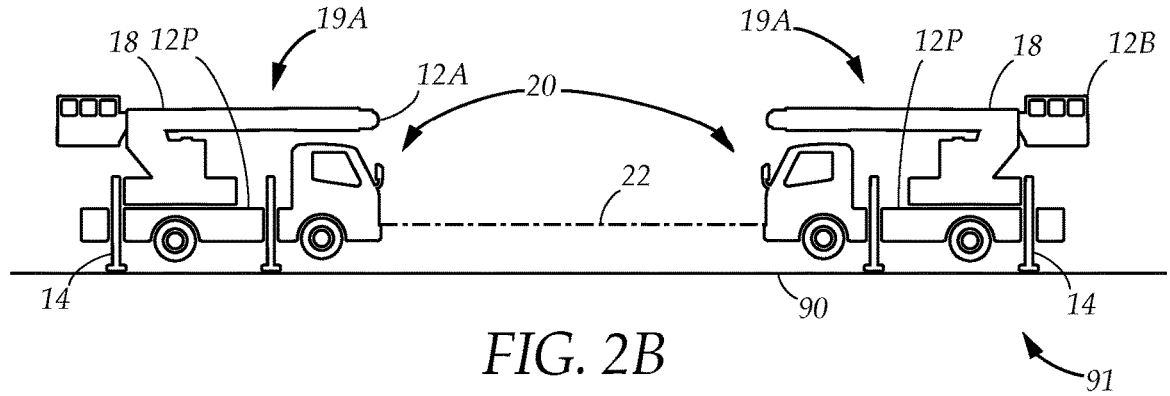
FIG. 2B is a diagrammatical side view showing the pair of lift vehicles employing anchoring mechanisms to stabilize the lift vehicles upon a ground surface, in accordance with an embodiment in the present disclosure.
Figure 2C:
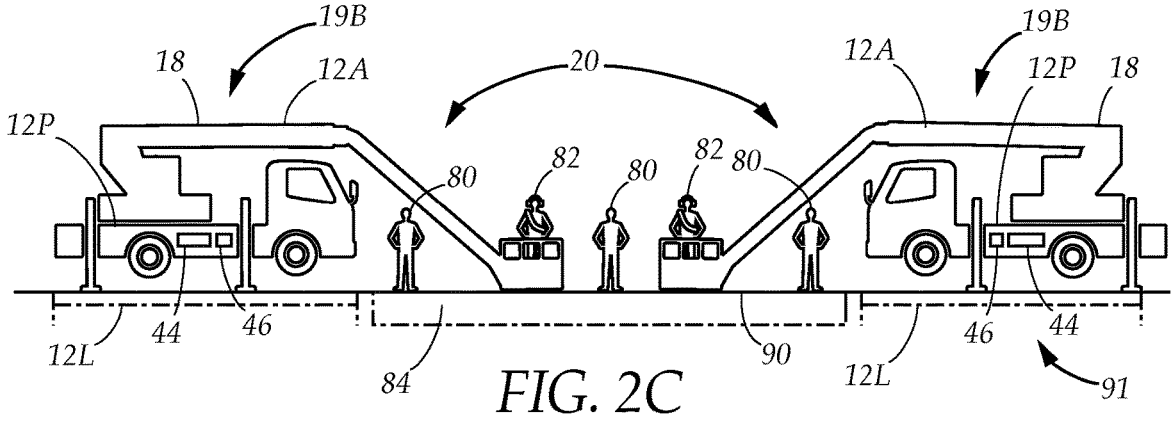
FIG. 2C is a diagrammatical side view showing a loading zone formed between the lift vehicles, and the observation platform of each vehicle is lowered into the loading zone in preparation to allow passengers to enter, in accordance with an embodiment in the present disclosure.

Turning to FIGS. 2A-C while continuing to refer to FIG. 1, the lift vehicles 12 are employed in a paired configuration 20, in which the first lift vehicle 12A and the second lift vehicle 12B are both positioned upon the ground surface 90 and are separated by an operating interval 22. The observation platforms 16 of the first and second lift vehicles 12A, 12B may be referred to as a first observation platform 16A and a second observation platform 16B respectively. In one embodiment, each lift vehicle 12 has a vehicle front 12F and a vehicle rear 12R, and the vehicle front 12F of the first lift vehicle 12A faces the vehicle front of the second lift vehicle 12B when the lift vehicles 12 are positioned in the paired configuration 20. Each lift vehicle 12 has a vehicle length 12L as measured between the vehicle front 12F and vehicle rear 12R, and in certain embodiments, the operating interval 22 is approximately equal to one vehicle length 12L. Each lift vehicle 12 may also have an anchoring mechanism 14 adapted to stabilize the lift vehicle 12 upon the ground surface 90. The anchoring mechanism 14 may be outriggers, stabilizers, or similar devices. The anchoring mechanism 14 is deployed once each lift vehicle 12 is properly positioned in the paired arrangement 20.

The lift mechanism 18 may be configured to alternate between several positions. When each lift vehicle 12 is moving, the lift mechanism 18 may be positioned in a fixed traveling position 19A where the lift mechanism 18 is retracted and the observation platform 16 is held proximate to the vehicle body 12P. The lift mechanism 18 may be lowered to a loading position 19B which allows the passengers 80 to enter or exit the observation platform 16. The lift mechanism 18 may elevate the observation platform 16 upwardly away from the ground surface 90 to a raised position 19C. Furthermore, in a preferred embodiment, the lift mechanism 18 is also capable of lateral movement, and is adapted to move the observation platform 16 laterally towards the other lift vehicle 12 as well as the other observation platform 16. The lift mechanism 18 may also be adapted to rotate, allowing the observation platform 16 to be turned in either a leftward or rightward direction in relation to the vehicle front 12F. In one embodiment, a loading area 84 is formed upon the ground surface 90 between the first vehicle 12A and the second vehicle 12B. The observation platform 16 of each lift vehicle 12 may be placed within the loading area 84 when the lift mechanism 18 is in the loading position 19B.

Figure 3:
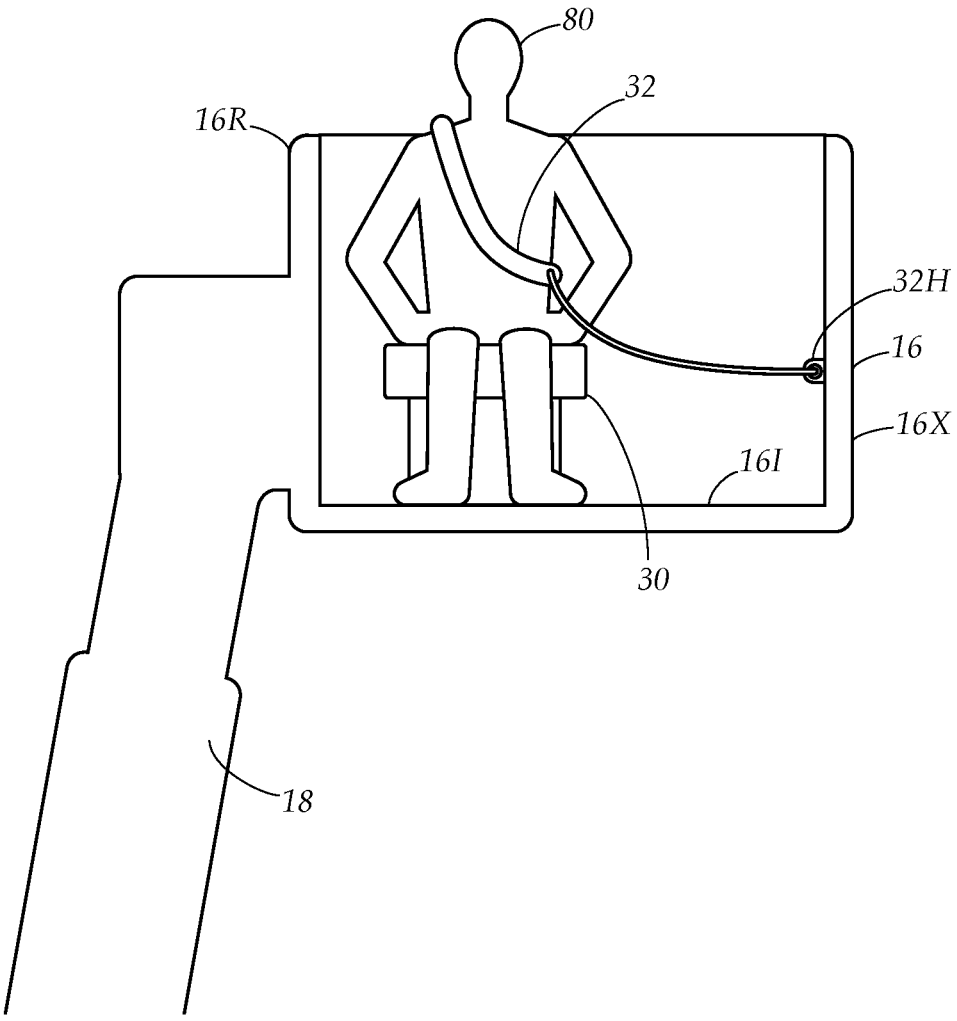
FIG. 3 is a diagrammatical side view of an observation platform interior, showing a seat and safety harness for supporting and securing the passenger, in accordance with an embodiment in the present disclosure.

Turning to FIG. 3 while also referring to FIG. 1 and FIG. 2C, the observation platform 16 has a platform interior 161 which is adapted to house and support the passengers 80 and the operator 82, and a platform exterior 16X which is adapted to enclose the platform interior 161. In one embodiment, the platform exterior 16X is formed of one or more guardrails 16R adapted to safely contain the passengers 80 within the platform interior 161. The observation platform 16 may also have one or more seats 30 adapted to accommodate the passengers 80. Each passenger 80 may be secured to the observation platform 16 using a safety harness 32. The safety harness 32 may be attached to any point within the platform interior 161, and in certain embodiments, may be attached to a safety hook 32H. Each observation platform 16 may be configured to hold any number of passengers 80. For example, in one embodiment, the observation platform 16 may have sufficient seats 30 to accommodate four passengers 80. Note that the observation platform 16 may be implemented using a variety of different cabins, buckets, cages, and other types of aerial platforms as will be appreciated by a person of ordinary skill in the art in the field of the invention.

Figure 4:
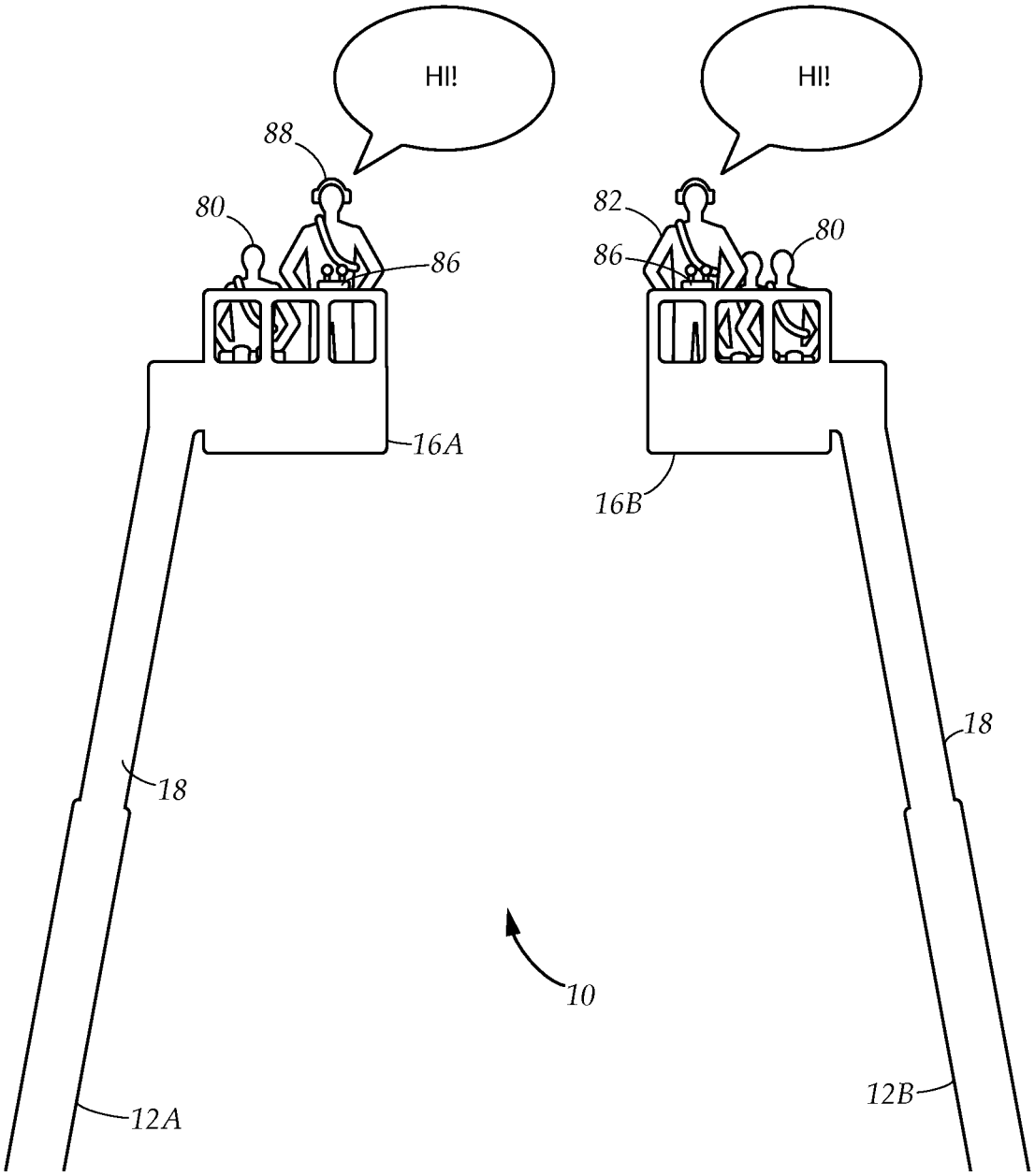
FIG. 4 is a diagrammatical side view of the mobile recreational lift system in operation where the observation platforms of both lift vehicles are simultaneously elevated, in accordance with an embodiment in the present disclosure.

Referring to FIG. 4 while continuing to refer to FIG. 1, FIG. 2C, and FIG. 3, the observation platform 16 further has lift controls 86 which allow the operator 82 to control the movement of the lift mechanism 18 and the observation platform 16 of the lift vehicle 12. Furthermore, each operator 82 may be equipped with a voice communication device 88 which allows the operators 82 of each observation platform 16 to communicate with each other to coordinate the movement of each observation platform 16. The voice communication device 88 may be as a headset, walkie-talkie, or other RF based two-way radio transceiver, or any suitable communication device as will be apparent to a person of ordinary skill in the art in the field of the invention. Note that in certain embodiments, the operator 82 and/or the passengers 80 may stand within the platform interior 161. Once the passengers 80 have entered the observation platform 16 and have been secured to their safety harnesses 32, the lift mechanism 18 of each lift vehicle 12 may elevate the observation platform 16 to the raised position 19C. In a preferred embodiment, the first and second observation platforms 16A, 16B are simultaneously elevated. By placing the lift vehicles 12 in the paired arrangement 20 separated by the operating interval 22, the lift mechanism 18 of the first lift vehicle 12A is able to move the first observation platform 16A laterally towards the second observation platform 16B, and vice versa, allowing the passengers 80 within one observation platform 16 to interact with the passengers 80 within the other observation platform 16 through speech and/or gestures. The length of the observation interval 22 may therefore vary depending on the vehicle length 12L and the lateral range of motion of the lift mechanisms 18 of each lift vehicle 12. For example, in one embodiment, each lift vehicle 12 may be approximately thirty-five to forty-five feet long, while the operating interval 22 may be approximately thirty to forty feet long.

Each observation platform 16 may be elevated to any height as allowed by the lift mechanism 18. For example, boom lifts are capable of reaching over three hundred feet in height. Over the course of the observation tour, the observation platforms 16 may be elevated by increments of increasing height. The passengers 80 may also ask the operator 82 to make specific movements. For example, the passengers 80 within the first observation platform 16A may ask the operator 82 to move the first observation platform 16A laterally towards the second observation platform 16B, or even to rotate the first observation platform 16A to better observe the observation site 91 or the surrounding environment 92. Once the observation tour is concluded, each observation platform 16 is lowered towards the ground surface 90, allowing the passengers 80 to exit the observation platforms and return to the loading area 84. In addition, any passenger 80 may signal to the operator 82 to end the observation tour, whereupon the observation platform 16 will immediately return to the loading area 84. Although both the first and second observation platforms 16A, 16B may be simultaneously elevated, both remain capable of independent operation, allowing one of the observation platforms 16 to return to the loading area 84 while the other observation platform remains in the raised position 19C.

Figure 5:
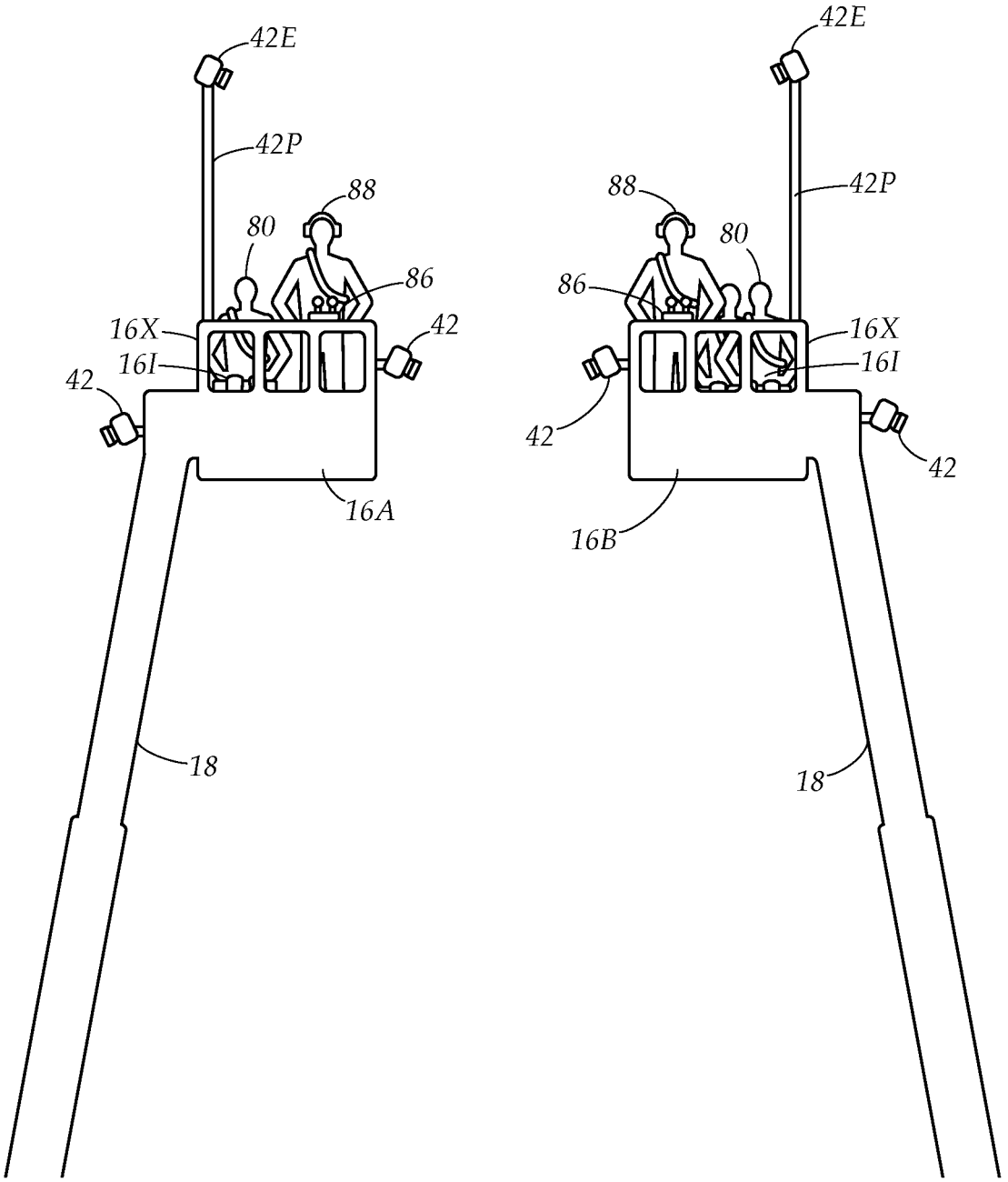
FIG. 5 is a diagrammatical side view showing a plurality of cameras positioned upon each observation platform and the lift mechanisms, which facilitate mutual video and photographic observation of the observation platforms, passengers, and surrounding environment, in accordance with an embodiment in the present disclosure.

Turning to FIG. 5 while continuing to refer to FIG. 1 and FIG. 2C, each lift vehicle 12 may also have one or more cameras 42 positioned at various points on the lift mechanism 18 and the observation platform 16. The cameras 42 are capable of capturing images of the observation platform 16 and the passengers 80 during the observation tour, such as video and/or photographs, and may be placed and oriented towards the surrounding environment 92, the ground surface 90, the platform interior 161 and the passengers 80 within, as well as the observation platform 16 of the other lift vehicle 12 and its passengers 80. For example, over the course of the simultaneous elevated observation tour, the cameras 42 attached to the first observation platform 16A may capture images of the second observation platform 16B from various angles and relative elevations. When the first observation platform 16A is elevated above the second observation platform 16B, the cameras 42 of the first elevation platform 16A may capture images of the second observation platform 16B with the observation site 91 and the surrounding environment 92 as a background for the image. By employing one of the lift vehicles 12 to capture images of the observation platform 16 of the other lift vehicle 12, it is possible to capture external images of the other observation platform 16 when the observation platforms 16 are separated by any distance. Each observation platform 16 may further have an extension pole 42P which projects upwardly away from the platform exterior 16X. At least one of the cameras 42 may be mounted upon the extension pole 42P to form an elevated camera 42E, allowing downwardly oriented images of the first or second observation platforms 16A, 16B to be captured when both observation platforms 16 are at the same elevation above the ground surface 90. In certain embodiments, the cameras 42 may be adapted to automatically track the observation platform 16 of the other lift vehicle 12, such as by using motion tracking cameras which are well known in the field of photography. The cameras 42 may also be used to directly capture images of the observation site 91 and/or the surrounding environment 92, such as by positioning the observation platform 16 at an optimal direction and facing for capturing appealing images.

Furthermore, each lift vehicle 12 may have one or more screens 44 positioned on, or in proximity of, the vehicle body 12P. The images captured by the cameras 42 may be transmitted and displayed upon the screens 44, which are positioned in view of any passengers 80 who have not yet entered the observation platform 16 and are waiting to take part in the elevated observation tour, or who have completed the observation tour and have returned to the ground surface 90. The screens 44 may therefore serve as entertainment for passengers 80, and may attract the attention of bystanders. Each lift vehicle 12 may have an image storage and distribution device 46 which is operably connected to the cameras 42 and the screens 44, and is adapted to store the captured images and allow the passengers 80 to purchase the images, whereupon the image storage and distribution device 46 may either distribute the images to the passengers 80 electronically, or produce a printed copy of the images through a photo printer or similar device. As will be appreciated by a person of ordinary skill in the art, the functions of the image storage and distribution device 46 are widely employed amongst amusement rides, and may be implemented using any suitable computing device.

Figure 6:
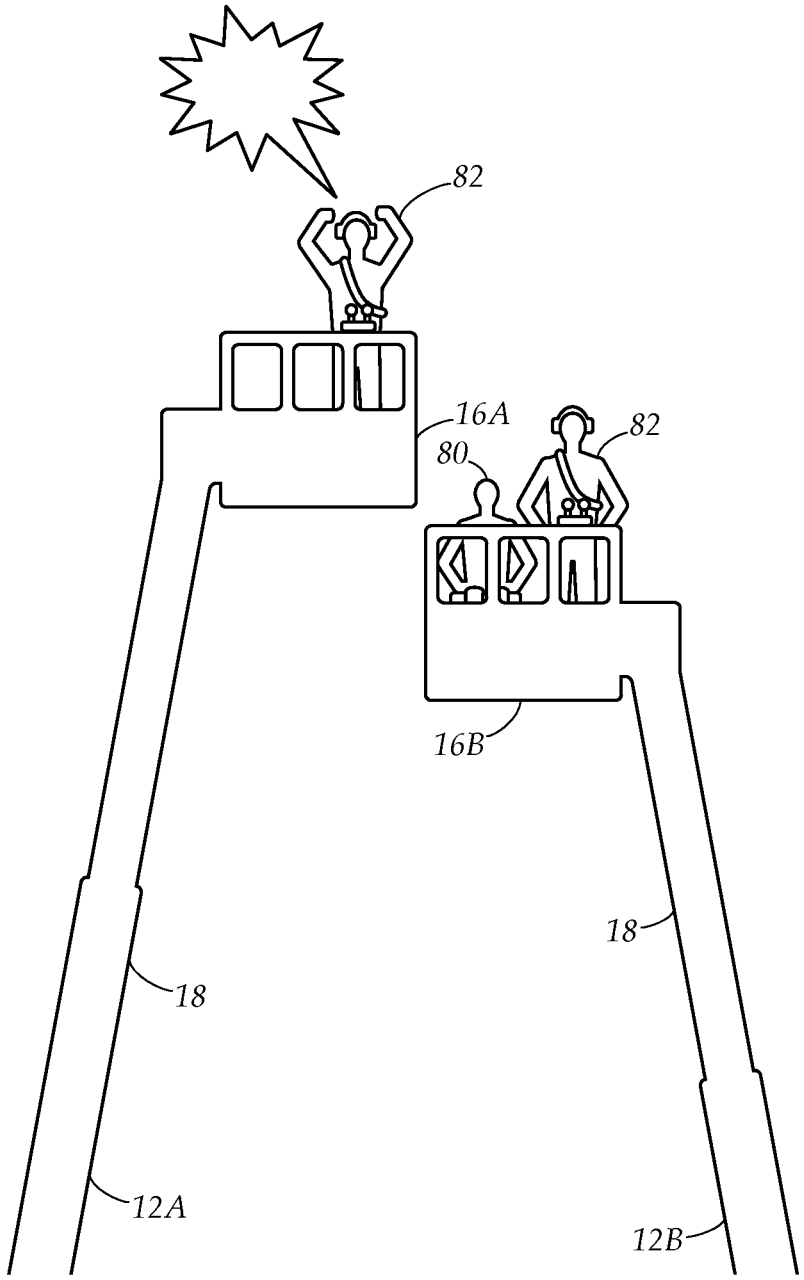
FIG. 6 is a diagrammatical side view showing the first observation platform approaching the second observation platform to render assistance in a situation where the second observation platform is disabled, in accordance with an embodiment in the present disclosure.

Turning to FIG. 6 while also referring to FIG. 1 and FIG. 3, the paired configuration 20 allows either lift vehicle 12 to immediately aid the other lift vehicle 12 in the event of a mechanical malfunction or other emergency. By employing two lift vehicles 12 separated by the operating distance 22, it is unnecessary to wait for the arrival of another vehicle or emergency services personnel with the capability to reach an elevated observation platform 16. For example, if the second lift vehicle 12B experiences a mechanical malfunction in its lift mechanism 18 which immobilizes the second observation platform 16B, the first observation platform 16A may be immediately moved to a position proximate to, or in contact with, the second observation platform 16B, allowing the operator 82 of the first observation platform 16A to assist the occupants of the second observation platform 16B. The first observation platform 16A may also receive the passengers 80 of the second observation platform 16B, and return the passengers 80 to the ground surface 90.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a mobile recreational lift system and methods for its use. The disclosure is illustrated by example in the drawing figures, and throughout the written description. It should be understood that numerous variations are possible, while adhering to the inventive concept. Such variations are contemplated as being a part of the present disclosure.

What is claimed is:

1. A method for conducting elevated observation for a plurality of passengers and operators at an observation site, the observation site is located upon a ground surface, comprising the steps of:

providing a pair of lift vehicles comprising a first lift vehicle and a second lift vehicle, each lift vehicle having a vehicle body, an observation platform, and a lift mechanism adapted to alternatively raise and lower the observation platform away from or toward the ground surface, each observation platform has a platform interior adapted to receive and support the passengers and one of the operators, and lift controls which allow one of the operators to control the observation platform of each lift vehicle, each lift vehicle has one or more cameras which are positioned upon the observation platform of the lift vehicle and are oriented towards the observation platform of the other lift vehicle;

positioning the first and second lift vehicles at the observation site in a paired configuration and separating the first and second lift vehicles by an operating interval;

receiving the passengers within the observation platforms of both the first and second lift vehicles;

simultaneously raising the observation platforms of the first and second lift vehicles away from the ground surface, providing the passengers with an elevated view of the observation site;

capturing images of the observation platforms of the first and second lift vehicles and the passengers therein using the cameras of the second and first lift vehicles respectively; and laterally moving the observation platform of the first lift vehicle across the operating interval towards the observation platform of the second vehicle, and assisting the observation platform of the second lift vehicle using the observation platform of the first lift vehicle upon an occurrence of a malfunction of the second lift vehicle.

2. The first method as described in claim 1, wherein:

each lift vehicle has a vehicle front and a vehicle rear; and the step of positioning the first and second lift vehicles at the observation site further comprises orienting the vehicle front of the first lift vehicle towards the vehicle front of the second lift vehicle.

3. The method as described in claim 2, wherein:

the step of positioning the first and second lift vehicles at the observation site is followed by the step of:

defining a loading area upon the ground surface between the vehicle front of the first lift vehicle and the vehicle front of the second lift vehicle, and lowering the observation platform of each lift vehicle onto the loading area.

4. The method as described in claim 3, wherein:

each observation platform further has a plurality of safety harnesses adapted to secure each passenger within the platform interior; and the step of receiving the passengers within the observation platforms further comprises securing each passenger using the safety harnesses.

5. The method as described in claim 4, wherein:

the step of providing a pair of lift vehicles is followed by the step of:

providing a voice communications device to each operator, adapted to allow the operators to communicate; and the step of receiving the passengers is preceded by the step of establishing and maintaining voice communication between the operators to coordinate the raising and lowering of the observation platforms.

6. The method as described in claim 5, wherein:

the step of laterally moving the observation platform of the first lift vehicle across the operating interval is followed by the step of:

transferring the passengers of the second lift vehicle from the platform interior of the observation platform of the second lift vehicle to the platform interior of the observation platform of the first lift vehicle, and returning the passengers of the second lift vehicle to the loading area.

7. The method as described in claim 6, wherein:

each lift vehicle further has an anchoring mechanism adapted to secure the lift vehicle upon the ground surface; and the step of positioning the first and second lift vehicles at the observation site further comprises securing each lift vehicle upon the ground surface using the anchoring mechanism of the lift vehicle.

8. The method as described in claim 7, wherein:

each lift vehicle further has a screen operably connected to the cameras of the lift vehicle, the screen is positioned upon the vehicle body; and the step of capturing images of the observation platforms further comprises displaying the images using the screens of the lift vehicles.

9. The method as described in claim 8, wherein:

each lift vehicle has a vehicle length as measured between the vehicle front and the vehicle rear; and the step of positioning the first and second lift vehicles at the observation site further comprises separating the first and second lift vehicles by the operating interval corresponding to the vehicle length of the lift vehicles.

10. The method as described in claim 9, wherein:

each lift vehicle further has an elevated camera attached to the observation platform of the lift vehicle via an extension pole which projects upwardly; and the step of capturing images of the observation platforms further comprises capturing downwardly oriented images of the observation platforms of the first and second lift vehicles and the passengers therein, using the extension cameras of the second and first lift vehicles respectively.

* * * * *